United States Patent [19]

Rybicki et al.

[11] Patent Number: 5,043,652

[45] Date of Patent: Aug. 27, 1991

[54] DIFFERENTIAL VOLTAGE TO DIFFERENTIAL CURRENT CONVERSION CIRCUIT HAVING LINEAR OUTPUT

[75] Inventors: Mathew A. Rybicki, Austin, Tex.; Katsufumi Nakamura, Pittsburgh, Pa.

[73] Assignee: Motorola, Inc., Schaumburg, Ill.

[21] Appl. No.: 590,853

[22] Filed: Oct. 1, 1990

[51] Int. Cl.[5] ..... G05F 3/20

[52] U.S. Cl. ..... 323/316; 323/315; 307/261; 307/296.6

[58] Field of Search ..... 323/312, 313, 314, 315, 323/316; 307/260, 261, 296.1, 296.8, 296.6; 330/288, 257

[56] References Cited

U.S. PATENT DOCUMENTS

| | | | |
|---|---|---|---|
| 4,442,400 | 4/1984 | Nagano | 323/315 |
| 4,550,262 | 10/1985 | Kohsiek | 323/316 |
| 4,769,590 | 9/1988 | Taylor | 323/315 |
| 4,866,312 | 9/1989 | Kearney et al. | 323/316 |
| 4,952,866 | 8/1990 | Van Tuijl | 307/296.6 |
| 4,961,046 | 10/1990 | De Jager | 307/261 |

OTHER PUBLICATIONS

"Sigma-Delta Modulator as an A/D Converter", Rudy J. Van De Plassche, IEEE Transactions on Circuits and Systems, vol. CAS-25, No. 7, Jul. 1978.

*Primary Examiner*—Peter S. Wong
*Attorney, Agent, or Firm*—Joe E. Barbee

[57] ABSTRACT

A voltage that is proportional to a differential input voltage is applied across two resistors. Each resistor produces a current that is proportional to the input voltage. The current from each resistor flows through an associated current mirror. Each current mirror produces a current equal to the current flowing through the associated resistor. The current produced by each current mirror becomes an output current that is proportional to the input voltage.

11 Claims, 1 Drawing Sheet

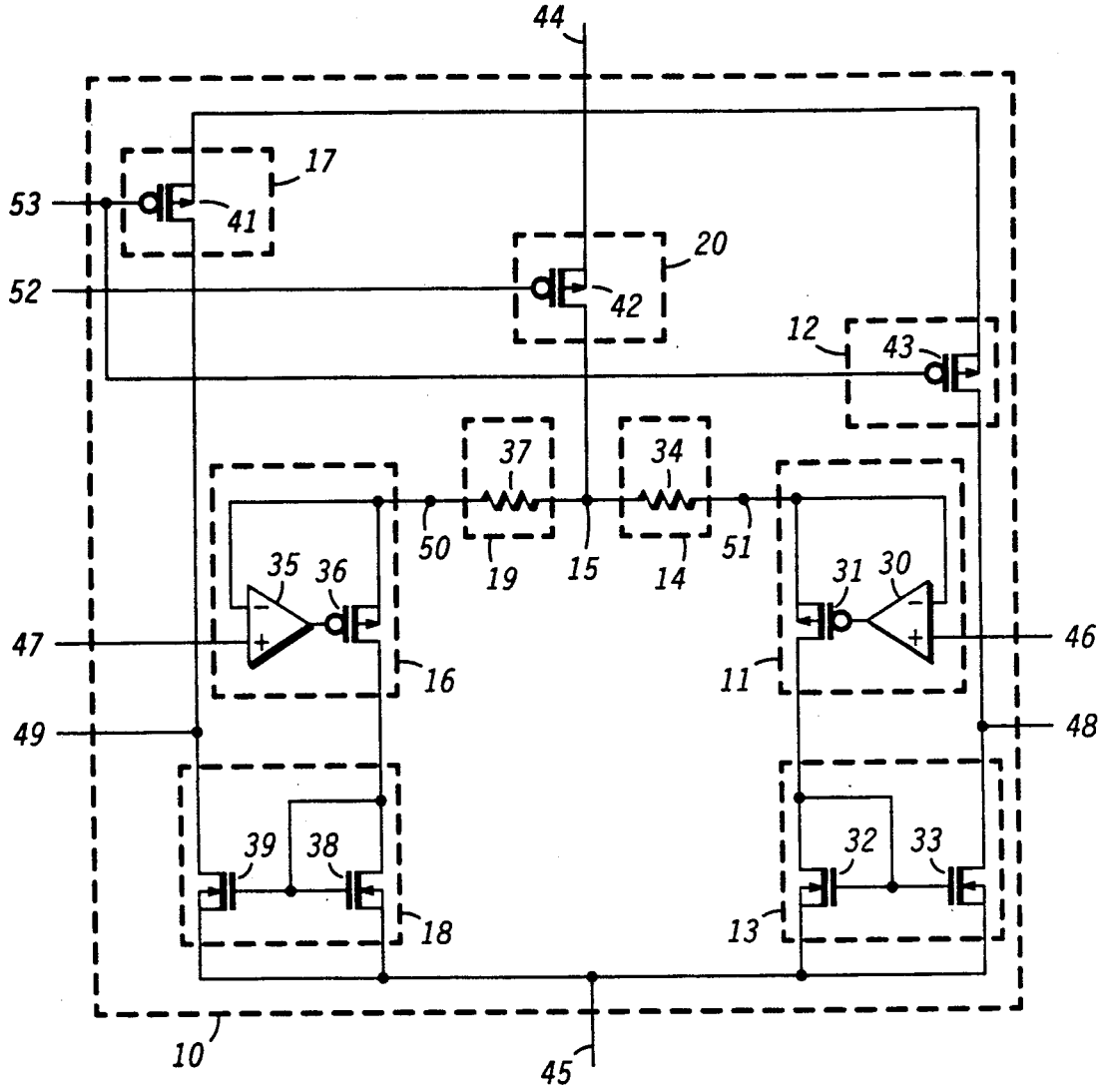
FIG. 1
FIG. 2
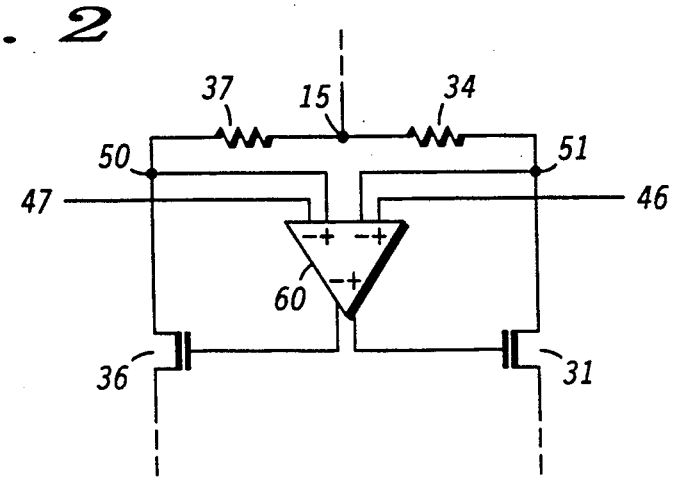

DIFFERENTIAL VOLTAGE TO DIFFERENTIAL CURRENT CONVERSION CIRCUIT HAVING LINEAR OUTPUT

BACKGROUND OF THE INVENTION

The present invention relates, in general, to analog voltage conversion circuits, and more particularly, to circuits for converting a differential voltage to a differential current.

Previous implementation methods for differential voltage to differential current conversion circuits were limited by the transconductance of the transistors used to implement the circuit. The low transconductance of transistors used in previous implementations allowed the transistor's non-linear source impedance to become sufficiently large enough to effect other resistances in the circuit. Since the source impedance was non-linear, the output current produced by these circuits had a non-linear relation to the input voltage. Accordingly, it would be desirable to have a differential voltage to differential current conversion circuit that provided a linear output current that was proportional to the input voltage and was independent of the transconductance of the transistors used in the implementation.

SUMMARY OF THE INVENTION

The objects and advantages of the present invention are achieved by creating a voltage across two resistors that is proportional to a differential input voltage. Each resistor produces a current that is proportional to the input voltage. The current from each resistor flows through an associated current mirror that produces a current equal to the current flowing through the resistor. The current produced by each current mirror becomes an output current that is proportional to the input voltage.

BRIEF DESCRIPTION OF THE DRAWINGS

FIG. 1 is a schematic representation of a differential voltage to differential current conversion circuit in accordance with the present invention.

FIG. 2 is an alternate configuration for a portion of the schematic of FIG. 1.

DETAILED DESCRIPTION OF THE DRAWINGS

The present invention provides a differential voltage to differential current conversion circuit that produces a linear output current which is proportional to the input voltage. A differential input voltage is amplified and applied across two resistances connected to a reference node. A voltage is developed across the resistances which creates a current through each resistance that is proportional to the input voltage. Each current flows through a current mirror that causes an equal current to flow through an output terminal.

While the invention is described with specific preferred embodiments, it is evident that many alternatives and variations will be apparent to those skilled in the semiconductor art. More specifically the invention has been described with a particular implementation using N-well CMOS transistors, although the method is directly applicable to other CMOS processes, as well as other processes.

FIG. 1 is a schematic representation of a circuit 10 which is a differential voltage to differential current conversion circuit having input terminals 46 and 47, output terminals 48 and 49, a unity gain amplifier 11, a unity gain amplifier 16, a resistance 14, a resistance 19, a reference node 15, a current mirror 13, a current mirror 18, a current source 20, a current source 12, and a current source 17.

Current source 20 has transistor 42 which has a source electrode connected to a supply voltage terminal 44, a gate electrode connected to a control voltage terminal 52, and a drain electrode connected to a reference node 15. Unity gain amplifier 11 includes a high gain amplifier 30 and a transistor 31. High gain amplifier 30 has a first or non-inverting input connected to input terminal 46 of circuit 10, and an output connected to a gate electrode of transistor 31. A second or inverting input of high gain amplifier 30 is connected to a source electrode of transistor 31. High gain amplifier 30 effectively increases the transconductance of transistor 31 so that the current flow through transistor 31 is independent of the transistor's transconductance. Resistance 14 includes a resistor 34 which has a first terminal connected to reference node 15, and a second terminal 51 connected to the source electrode of transistor 31. Current mirror 13 has transistors 32 and 33. Transistor 32 has a source electrode connected to supply voltage terminal 45. A gate electrode of transistor 32 is connected to a drain electrode of transistor 32, to a drain electrode of transistor 31, and to a gate electrode of transistor 33. Transistor 33 has a source electrode connected to supply voltage terminal 45, and a drain electrode connected to output terminal 48 of circuit 10.

Unity gain amplifier 16 has a high gain amplifier 35 and a transistor 36. High gain amplifier 35 has a first or non-inverting input connected to input terminal 47 of circuit 10, and an output connected to a gate electrode of transistor 36. A second or inverting input of high gain amplifier 35 is connected to a source electrode of transistor 36. High gain amplifier 35 effectively increases the transconductance of transistor 36 so that the current flow through transistor 36 is independent of the transistor's transconductance. Resistance 19 includes a resistor 37 which has a first terminal connected to reference node 15, and a second terminal 50 connected to the source electrode of transistor 36. Current mirror 18 has transistors 38 and 39. Transistor 38 has a source electrode connected to supply voltage terminal 45. A gate electrode of transistor 38 is connected to a drain electrode of transistor 38, to a drain electrode of transistor 36, and to a gate electrode of transistor 39. Transistor 39 has a source electrode connected to supply voltage terminal 45, and a drain electrode connected to output terminal 49 of circuit 10.

Current source 12 includes transistor 43 which has a source electrode connected to supply voltage terminal 44, a drain electrode connected to the drain electrode of transistor 33, and a gate electrode connected to a control voltage terminal 53. Current source 17 includes transistor 41 which has a source electrode connected to supply voltage terminal 44, a drain electrode connected to the drain electrode of transistor 39, and a gate electrode connected to control voltage terminal 53.

With no differential voltage applied to inputs 46 and 47, current source 20 provides a constant current to reference node 15. This current divides at reference node 15 and one-half flows through resistance 14, through transistor 31 of unity gain amplifier 11, and through transistor 32 of current mirror 13 to supply voltage terminal 45. Current mirror 13 establishes a current flow in transistor 33 that is equal to the current flow in transistor 32. Current source 12 provides a second constant current that is equal to one-half of the constant current provided by current source 20. This second constant current, which flows through transistor 33 of current mirror 13 to supply voltage terminal 45, is the current established by the current mirror action of transistors 32 and 33.

The other one-half of the current supplied by current source 20 flows from reference node 15 through resistance 19, through transistor 36 of unity gain amplifier 16, and through transistor 38 of current mirror 18 to supply voltage terminal 45. Current mirror 18 establishes a current flow in transistor 39 that is equal to the current flow in transistor 38. Current source 17 provides a third constant current that is equal to one-half of the constant current provided by current source 20. This third constant current, which flows through transistor 39 of current mirror 18 to supply voltage terminal 45, is the current established by the current mirror action of transistors 38 and 39.

Consequently, with no differential input voltage applied to inputs 46 and 47, balanced current flows are established in differential voltage to differential current conversion circuit 10.

Differential voltages applied to input terminals 46 and 47 are amplified by unity gain amplifiers 11 and 16 which establish an equal voltage between terminals 51 and 50 of resistances 14 and 19. The voltage between terminals 50 and 51 divides evenly between resistors 14 and 19 resulting in a relative voltage across resistance 14 and a separate relative voltage across resistance 19. The relative voltage that is across resistance 14 develops a first differential current, flowing through resistance 14, that is summed to the constant current already flowing through resistance 14. The first differential current also flows through transistor 31 of unity gain amplifier 11 and through transistor 32 of current mirror 13. As the first differential current flows through transistor 32, an equal current is established through transistor 33 that is summed to the constant current already flowing through transistor 33. Since the current flow through transistor 43 is constant, the sum of the two currents flowing through transistor 33 separates at output terminal 48. The constant current portion continues to flow through transistor 43 while a current equal to the first differential current flows through the load (not shown) that is connected to terminal 48. The portion of the relative voltage that is reflected across resistance 19 develops a second differential current, flowing through resistance 19, that is summed to the constant current already flowing through resistance 19. The second differential current also flows through transistor 36 of unity gain amplifier 16 and through transistor 38 of current mirror 18. As the second differential current flows through transistor 38, an equal current is established through transistor 39 that is summed to the constant current already flowing through transistor 39. Since the current flow through transistor 41 is constant, the sum of the two currents flowing through transistor 39 separates at output terminal 49. The constant current portion continues to flow through transistor 41 while a current equal to the first differential current flows through the load (not shown) that is connected to terminal 49. Therefore, the differential output current that flows between output terminals 48 and 49 is equal to the differential input voltage divided by the sum of resistances 14 and 19, and is essentially independent of the transconductance of the transistors used to implement the circuit. Consequently, the circuit provides an output current that has a linear relationship to the input voltage. Since the output of circuit 10 is a current and not a voltage, the circuit will provide a linear differential current that is proportional to the differential input voltage for low supply voltages (as low as approximately 2.5 volts).

Control voltage terminal 52 is used to control the bias current flowing through constant current source 20. Control voltage terminal 53 is used to control the current flowing through constant current sources 17 and 12. Control voltage terminal 53 can also be used to control common mode voltages that can develop on output terminals 48 and 49. The circuits necessary to develop the signals applied to control voltage terminal 52 and 53 are not shown in FIG. 1. In another embodiment, these circuits could be included as a portion of circuit 10.

In the preferred embodiment, transistors 41, 42, and 43 are P-channel CMOS transistors that have the well of the transistor connected to the source electrode of the transistor. Transistors 41 and 43 are matched to each other and ratioed to transistor 42 so that transistor 42 has electrical characteristics equal to transistors 41 and 43 when conducting twice the current of transistors 41 and 43. Transistors 38 and 39 are matched N-channel CMOS transistors that have the substrate of the transistor connected to the source electrode. The close matching insures current mirror IE produces an accurate current flow in transistor 39 thereby reducing errors and providing an output current that is proportional to the input voltage. Transistors 32 and 33 are matched N-channel transistors that have the substrate of the transistor connected to the source electrode. The close matching insures current mirror 13 produces an accurate current flow in transistor 33 thereby reducing errors and providing an output current that is proportional to the input voltage. The close matching of these transistors reduces output errors and provides a differential current that has a linear relation to the input voltage. Also in this preferred embodiment, transistors 31 and 36 are matched P-channel CMOS transistors that have the well of the transistor connected to the source electrode. This reduces the gate to source voltage of each transistor to improve the input common mode range of circuit 10.

Referring to FIG. 2, it can be readily determined that amplifier 60 could be used in FIG. 1 as a substitute for high gain amplifiers 30 and 35. Amplifier 60 is a fully differential high gain amplifier having two pair of differential inputs, and a differential output. Input terminal 46 of circuit 10 is now connected to a first non-inverting input of amplifier 60. Second terminal 51 of resistor 34 is now connected to a first inverting input of amplifier 60. Input terminal 47 of circuit 10 is now connected to a second inverting input of amplifier 60, and second terminal 50 of resistor 37 is now connected to a second non-inverting input of amplifier 60. The gate electrode of transistor 31 is now connected to a first output of amplifier 60. The first output is a non-inverting output which provides a voltage that is proportional to the voltage at input terminal 46 minus the voltage at terminal 51. This is the same function that is provided by amplifier 30 in FIG. 1. A second output of amplifier 60 is an inverting output that is connected to the gate electrode of transistor 36. Since the second output is inverting, it provides a voltage (V2) that is proportional to minus the quantity of the difference of the voltage at terminal 50 (V50) minus the voltage at input terminal 47 (V47). Expressed in equation terms, V2 is proportional to −(V50−V47) or V2 is proportional to (V47−V50). Therefore, the second output of amplifier 60 provides a voltage that is proportional to the voltage at input terminal 47 minus the voltage at terminal 50. This is the same function that is provided by amplifier 35 in FIG. 1. Therefore, amplifier 60 in FIG. 2 produces the same signals at terminals 50 and 51 that are produced by amplifiers 30 and 35 of FIG. 1.

By now it should be appreciated that there has been provided a novel way to convert a differential voltage to a differential current which produces a linear output current that is proportional to the input voltage. This circuit provides high speed conversion of a differential voltage to a differential current, and it can operate at low supply voltages. These characteristics allow the circuit to be used in portable, and battery powered equipment in addition to conventional applications at higher supply voltages. Current mode analog to digital conversion circuits, in addition to other analog circuits can benefit from using this differential voltage to differential current conversion circuit.

We claim:

1. A differential voltage to differential current conversion circuit with linear output which comprises:

a first transistor having a control electrode coupled to a first control voltage, a first current electrode coupled to a first supply voltage terminal, and a second current electrode;

a means of providing a first resistance having a first terminal coupled to the second current electrode cf the first transistor;

a second transistor having a first current electrode coupled to a second terminal of the means of providing a first resistance, a control electrode, and a second current electrode;

a third transistor having a control electrode coupled to its first current electrode and to the second current electrode of the second transistor, and a second current electrode coupled to a second supply voltage terminal;

a means of providing a second resistance having a first terminal coupled to the second current electrode of the first transistor;

a fourth transistor having a first current electrode coupled to a second terminal of the means of providing a second resistance, a control electrode, and a second current electrode;

a fifth transistor having a control electrode coupled to its first current electrode and to the second current electrode of the fourth transistor, and a second current electrode coupled to the second supply voltage terminal;

a sixth transistor having a control electrode coupled to a second control voltage, a first current electrode coupled to the first supply voltage terminal, and a second current electrode;

a seventh transistor having a first current electrode coupled to the second current electrode of the sixth transistor and to a first output terminal of the differential voltage to differential current conversion circuit, a second current electrode coupled to the second supply voltage terminal, and a control electrode coupled to the control electrode of the third transistor;

an eighth transistor having a control electrode coupled to the second control voltage, a first current electrode coupled to the first supply voltage terminal, and a second current electrode:

a ninth transistor having a first current electrode coupled to the second current electrode of the eighth transistor and to a second output terminal of the differential voltage to differential current conversion circuit, a second current electrode coupled to the second supply voltage terminal, and a control electrode coupled to the control electrode of the fifth transistor;

a first high gain amplifier having an output coupled to the control electrode of the second transistor, a first input coupled to the first current electrode of the second transistor, and a second input which is a first voltage input terminal of the differential voltage to differential current conversion circuit; and a second high gain amplifier having an output coupled to the control electrode of the fourth transistor, a first input coupled to the first current electrode of the fourth transistor, and a second input which is a second voltage input terminal of the differential voltage to differential current conversion circuit.

2. The differential voltage to differential current conversion circuit of claim 1 wherein the sixth, and eighth transistors are CMOS transistors with matched electrical characteristics.

3. The differential voltage to differential current conversion circuit of claim 1 wherein the first transistor is a CMOS transistor that is ratioed to the sixth and eighth transistors whereby the electrical characteristics of all three are matched when the current flowing in the first transistor is two times the current flowing in the sixth and eighth transistors.

4. The differential voltage to differential current conversion circuit of claim 1 wherein the third and seventh transistors are CMOS transistors with matched electrical characteristics.

5. The differential voltage to differential current conversion circuit of claim 1 wherein the fifth and ninth transistors are CMOS transistors with matched electrical characteristics.

6. A differential voltage to a differential current conversion circuit having a linear output which comprises:

means of providing a first current that is proportional to a first input voltage;

means of providing a second current that is proportional to a second input voltage;

means for providing a third current that is substantially equal to the first current wherein the third current forms a first output current; and means for providing a fourth current that is substantially equal to the second current wherein the fourth current forms a second output current.

7. The differential voltage to a differential current conversion circuit of claim 6 wherein the means for providing a first current includes a means for amplifying the first input voltage to form an amplified voltage, and a means for converting the amplified voltage to the first current which is proportional to the first input voltage.

8. The differential voltage to a differential current conversion circuit of claim 6 wherein the means for providing a second current includes a means for amplifying the second input voltage to form an amplified voltage, and a means for converting the amplified voltage to the second current which is proportional to the first input voltage.

9. The differential voltage to a differential current conversion circuit of claim 6 wherein the means for providing a third current includes the first current flowing through a transistor thereby inducing the third current to flow through another transistor whereby the third current is substantially equal to the first current.

10. The differential voltage to a differential current conversion circuit of claim 6 wherein the means for providing a fourth current includes the second current flowing through a transistor thereby inducing the fourth current to flow through another transistor whereby the fourth current is substantially equal to the second current.

11. A method for converting a differential voltage to a linear differential current which comprises:

amplifying a differential input voltage;

dividing the amplified voltage thereby establishing a first relative voltage and a second relative voltage;

converting the first relative voltage to a first differential current that is proportional to the differential input voltage;

converting the second relative voltage to a second differential current that is proportional to the differential input voltage;

establishing a third current that is substantially equal to the first differential current, wherein the third current forms a first output current; and establishing a fourth current that is substantially equal to the second differential current, wherein the fourth current forms a second output current.

* * * * *